US010154712B2

(12) United States Patent
Seaton et al.

(10) Patent No.: US 10,154,712 B2
(45) Date of Patent: Dec. 18, 2018

(54) CHARM AND CLOTHING ATTACHMENT DEVICE

(71) Applicants: Michael Louis Seaton, Palm Coast, FL (US); Alicia Vittone Seaton, Palm Coast, FL (US)

(72) Inventors: Michael Louis Seaton, Palm Coast, FL (US); Alicia Vittone Seaton, Palm Coast, FL (US)

( * ) Notice: Subject to any disclaimer, the term of this patent is extended or adjusted under 35 U.S.C. 154(b) by 436 days.

(21) Appl. No.: 15/097,812

(22) Filed: Apr. 13, 2016

(65) Prior Publication Data

US 2017/0119113 A1 May 4, 2017

Related U.S. Application Data

(60) Provisional application No. 62/248,703, filed on Oct. 30, 2015.

(51) Int. Cl.

| | |
|---|---|
| ***A44C 25/00*** | (2006.01) |
| ***A44C 1/00*** | (2006.01) |
| ***A41D 27/08*** | (2006.01) |
| ***A44B 13/02*** | (2006.01) |
| ***A44C 5/18*** | (2006.01) |
| ***A44C 5/20*** | (2006.01) |
| ***A44C 9/00*** | (2006.01) |

(52) U.S. Cl.

CPC ..... *A44C 25/007* (2013.01); *A41D 27/08* (2013.01); *A44B 13/02* (2013.01); *A44C 1/00* (2013.01); *A44C 5/185* (2013.01); *A44C 5/2019* (2013.01); *A44C 9/0038* (2013.01)

(58) Field of Classification Search

CPC ... A44C 25/007; A44C 9/0038; A44C 5/2019; A44C 5/185; A44C 1/00; A44B 13/02; A41D 27/08

See application file for complete search history.

(56) References Cited

U.S. PATENT DOCUMENTS

| | | | | |
|---|---|---|---|---|
| 3,465,543 | A * | 9/1969 | Baker | A44C 9/0038 24/598.2 |
| 4,790,148 | A * | 12/1988 | Faini | A44C 9/0038 24/574.1 |
| 7,568,364 | B1 * | 8/2009 | Buskop | A44C 7/005 362/104 |
| 2004/0159123 | A1 * | 8/2004 | Mohs | A44C 1/00 63/1.11 |
| 2008/0250678 | A1 * | 10/2008 | Kresser | A44C 1/00 40/1.5 |
| 2014/0338694 | A1 * | 11/2014 | Van Dyne | A44C 25/007 132/275 |
| 2015/0335104 | A1 * | 11/2015 | Dickie | A44B 13/02 119/792 |
| 2017/0020242 | A1 * | 1/2017 | Crafton | A44C 7/002 |
| 2018/0008015 | A1 * | 1/2018 | Heller | A44C 1/00 |

* cited by examiner

*Primary Examiner* — Robert Sandy
*Assistant Examiner* — Louis A Mercado
(74) *Attorney, Agent, or Firm* — Jason T. Daniel; Daniel Law Offices, P.A.

(57) ABSTRACT

A charm and clothing attachment device includes a main body having a hook portion, a moveable arm and a central aperture. An elongated shaft having a sharp tip along a distal end extends outward from the main body. A receiver having a cavity is removably connected to the elongated shaft. One or more charms, each having a loop portion are suspended from the hook portion of the main body.

8 Claims, 5 Drawing Sheets

CHARM AND CLOTHING ATTACHMENT DEVICE

CROSS-REFERENCE TO RELATED APPLICATIONS

This application claims the benefit of U.S. Application Ser. No. 62/248,703 filed on Oct. 30, 2015, the contents of which are incorporated herein by reference.

TECHNICAL FIELD

The present invention relates generally to jewelry, and more particularly to a device for securely attaching one or more charms onto virtually any article of clothing.

BACKGROUND

The statements in this section merely provide background information related to the present disclosure and may not constitute prior art.

Consumers desire the latest in fashion and apparel. They also like to wear accessories that allow them to personalize their look. In recent years, the fashion industry has seen an increase in the popularity of decorative ornaments such as charms, for example, which allow users to express their particular likes and interests. These charms can include an unlimited number of decorative elements, and can be directed toward any number of different topics such as travel locations, hobbies, nature, love, religion, and/or sports, for example, that allow a user to inject their personality and/or passion through the jewelry they wear.

Until the advent of the present invention, these charms were typically secured onto expensive jewelry such as necklaces and bracelets, for example that included a plurality of clasps for receiving and engaging the charms. However, owing to the high cost and delicate nature of such items, many users could not risk wearing their charms with swimwear, for example, as the likelihood of damage was too great.

Accordingly, there is a need for new type of charm attachment device that can function to secure one or more charms directly onto any article of clothing, including swimwear, for example, so as to allow a user to prominently display their charms when wearing any type of clothing.

SUMMARY OF THE INVENTION

The present invention is directed to a charm and clothing attachment device. One embodiment of the present invention can include a main body having a hook portion, a moveable arm and a central aperture. An elongated shaft can extend outward from the main body and can include a sharp tip along a distal end. A receiver can include a cavity for receiving the sharp tip portion of the shaft and securing the same in a non-permanent manner. One or more charms, each having a loop portion can be suspended from the hook portion of the main body.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described herein, the term "removably secured," and derivatives thereof shall be used to describe a situation wherein two or more objects are joined together in a non-permanent manner so as to allow the same objects to be repeatedly joined and separated.

Figure 1:
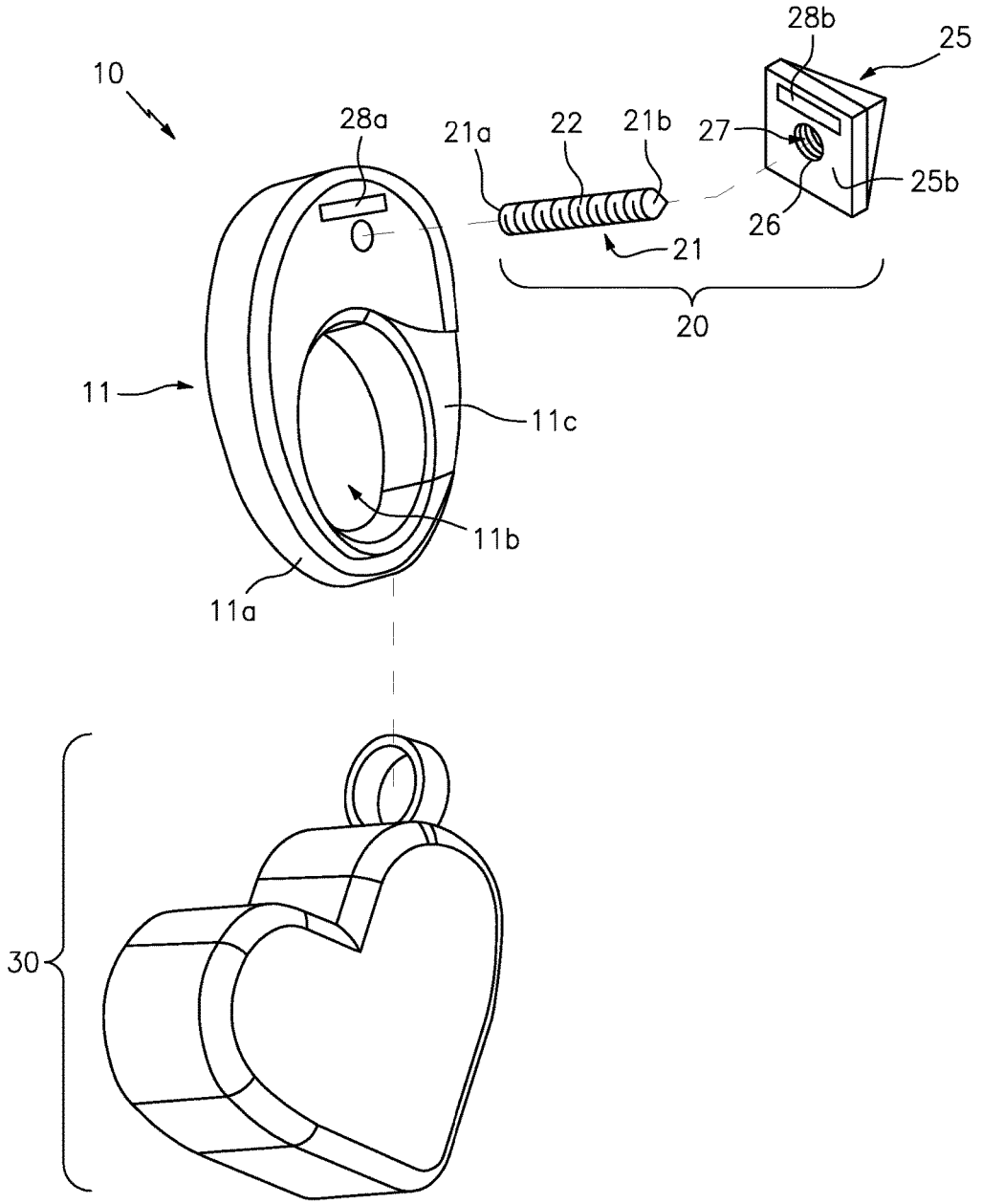
FIG. 1 is an exploded parts view of a charm and clothing attachment device that is useful for understanding the inventive concepts disclosed herein.
Figure 2:
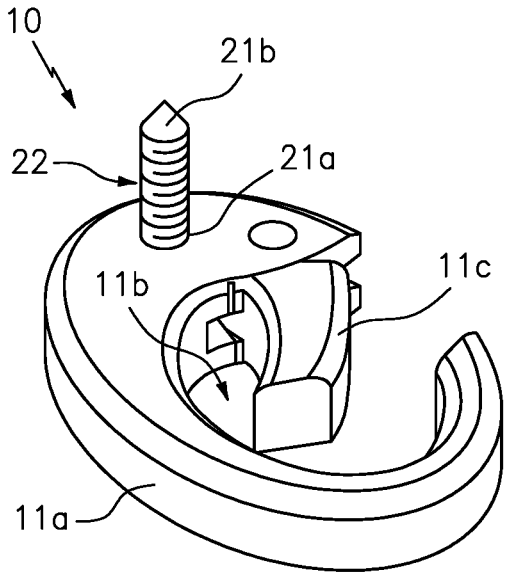
FIG. 2 is a perspective view of the main body of the charm and clothing attachment device, in accordance with one embodiment of the invention.
Figure 3:
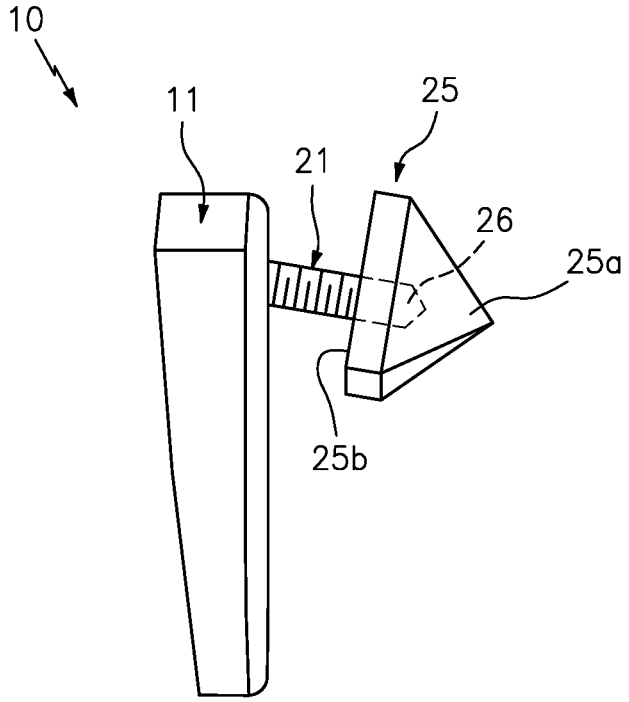
FIG. 3 is a side view of the charm and clothing attachment device, in accordance with one embodiment of the invention.
Figure 4:
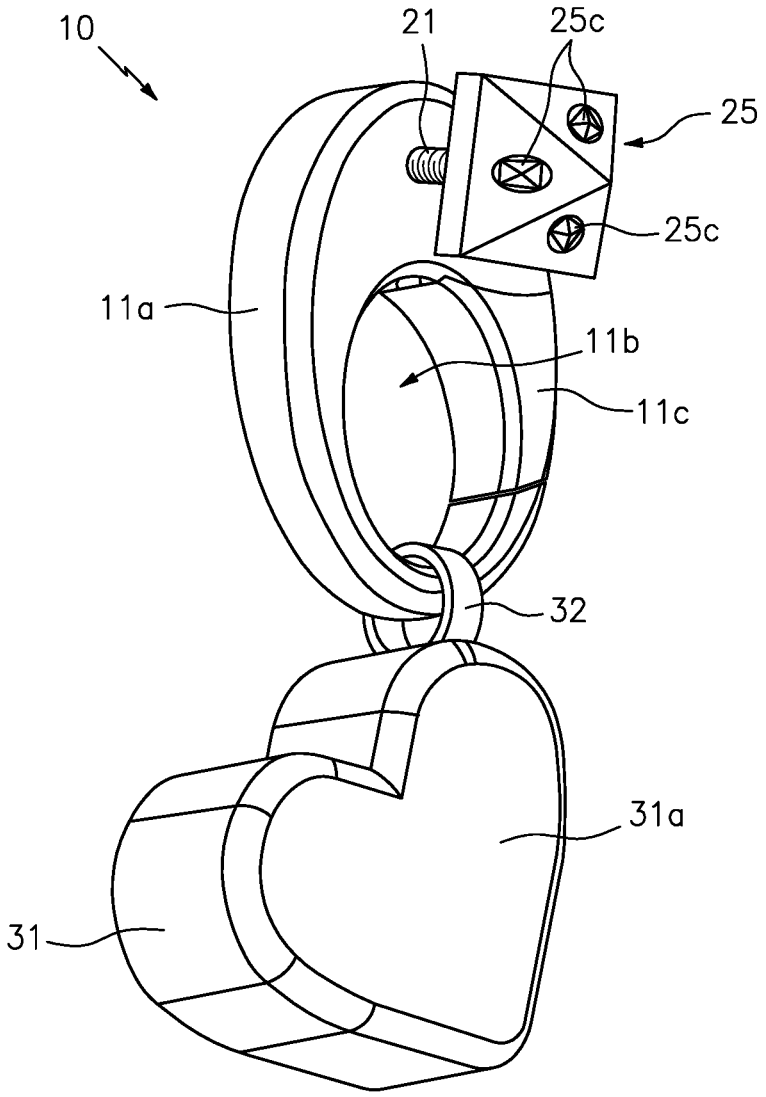
FIG. 4 is a perspective view of the charm and clothing attachment device, in accordance with one embodiment of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

Various embodiments of a charm and clothing attachment device will be described. Although the illustrations presented throughout this document show and describe the device as being secured onto an article of clothing having a strap, this is but one possible implementation of the device. As such, those of skill in the art will recognize that the inventive concepts disclosed herein can be utilized to secure any number of different charms onto any article of clothing at any location, without regard to the manufacturer and/or intended use of the same.

FIGS. 1-4 illustrate various embodiments of a charm and clothing attachment device 10 that is useful for understanding the inventive concepts disclosed herein. As shown, the device 10 can include, essentially, a main body 11, a clothing attachment unit 20, and one or more charms 30.

The main body can function to receive and securely retain any number of different charms, as may be desirable to a user. In one embodiment, the main body 11 can include a claw-type clasp having a generally curvilinear fixed-shape hook portion 11*a*, a central aperture 11*b*, and a moveable spring loaded arm portion 11*b* that can transition between the closed position shown in FIG. 1, and the open position shown in FIG. 2.

The main body can be constructed from any number of different materials, depending on the desired look or fashion to which the device is intended to be used. For example, high end versions of the device 10 can be constructed from precious metals such as gold, silver, or platinum, for example. Likewise, lower end versions of the device 10 can be made from less precious metals, such as aluminum, for example, as well as plastic and other suitably durable materials.

In the preferred embodiment, the central aperture of the main body can include a space/diameter of between approximately 0.125 and 0.5 inches, for example. Such a size being important for allowing the aperture to fully receive and encircle the strap of an article of clothing such as a swimsuit or bra, for example, which typically include widths of between approximately 0.06 and 0.5 inches.

Although described above with regard to a particular shape, size or dimensions, many other embodiments are also contemplated. To this end, the main body 11 can include or comprise any number of other types of clasps that are known in various industries by specific labels. Several nonlimiting examples include lobster claw type clasps, single or double push lock type clasps, snap bolts or bolt snaps (interchangeably used), snap hooks and carabiners, among other types of claps. The lobster claw type clasps may also include many variations, including standard lobster claws with or without jump rings, tear drop with or without jump rings, trigger clasp, lobster claw with swivel, infinity or figure-eight shaped lobster claw, oval cast clasp, dolphin shaped, heart shaped, among the many varieties available.

The clothing attachment unit 20 can function to secure the main body 11 onto an article of clothing. In the preferred embodiment, the unit 20 can include a shaft 21 that is removably secured to a receiver 25.

As shown, the shaft 21 can include an elongated member having a first end 21*a* that is permanently affixed to the front facing surface of the main body 11*a*, and a sharp tip 21*b* at the second end. The shaft is preferably extends outward from the main body at a 90 degree relative angle, however other angles ranging between 20 degrees and 160 degrees relative, are also contemplated.

The shaft will preferably be constructed from sturdy metal such as steel or aluminum, for example, however other construction materials such as gold, silver or plastic are also contemplated. In various embodiments, the shaft 21 can be formed as an integral part of the main body 11 or can be constructed as a separate element that is attached thereto by a permanent means such as one or more welds, for example.

A plurality of threaded elements 22 can be positioned along the outside surface of the shaft and can extend between the first and second ends. The shaft can include any number of different lengths and widths based on the intended use of the device and/or the types of construction materials used; however, in the preferred embodiment, the shaft can include a length (i.e., distance between the first and second ends), of between approximately 0.25 and 1 inch, for example. Such a dimension being suitable for passing through most commercially available articles of clothing.

The receiver 25 can function to receive the tip of the shaft 21*b*, and securely retain the same, after the shaft has passed through an article of clothing. In this regard, the receiver 25 can include a main body having a front facing surface 25*a*, a rear facing surface 25*b* and a cavity 26 extending from the rear facing surface towards the front facing surface. In the preferred embodiment, the cavity can also include a plurality of threaded elements 27 that are complementary to the threaded elements 22 positioned along the shaft 21. Threaded elements are well known in the art and include lands and grooves for securing complementary objects together via a twisting motion.

As the device 10 is designed to position the front surface of the receiver at a location that is visible to a user at all times, it is preferred that the receiver 25 include a decorative shape. To this end, the receiver can include any number of different shapes such as the illustrated pyramid, for example, and can also be constructed from any number of different materials such as gold, silver, platinum, aluminum, and/or plastic, for example. In various embodiments, the receiver can include one or more decorative indicia such as faux or real jewels 25*c*, for example, to provide the device with a more unique and/or stylistic look.

Although described above as utilizing a plurality of threaded elements along the shaft and receiver to connect the elements together, the device is not limited to the use of any single type of connector, as any number of different components capable of removably securing the shaft and receiver together can be utilized herein. For example, in another embodiment, a pair of magnets 28*a* and 28*b* can be secured along the main body 11 and the rear facing surface of the receiver 25*b*, respectively. Each of the magnets including opposite charges such that when the shaft 21 is inserted into the cavity 26 of the receiver, the receiver 25 and the main body 11 are attracted to each other, thereby securing the receiver and main body together. Such a feature can be used in conjunction with the above described threaded connectors or as an alternative thereto.

In yet another embodiment, the cavity 26 of the receiver 25 may include or comprise a piece of rubber having an aperture in line and slightly smaller in diameter than the width of the shaft it is to receive. When the shaft is inserted into the connector cavity the rubber aperture provides sufficient friction on the surface of the shaft to securely affix the elements together.

The charm 30 can include any number of commercially available or custom made objects, having a body portion 31 and a loop portion 32 that is capable of engaging the main body 11*a*, as shown. To this end, the body portion of the charm 31 can include any number of different shapes and sizes, such as the illustrated heart shape, for example, and can incorporate an unlimited number of decorative elements 31*a* such as various colors, markings, words, shapes, symbols, logos, designs, lights, types of materials, texturing of materials, patterns, images, lithographs, photographs and/or jewels, for example. These elements can be secured onto and/or into the charm body in accordance with known techniques so as to be flush with the surface thereof, or can be recessed, raised and/or protruding outward from the charm surface so as to give a three dimensional effect.

Although described above as being removable in nature, other embodiments are also contemplated wherein the charm 30 can be permanently secured to the main body 11 and/or can include an integral construction as the main body.

Figure 5A:
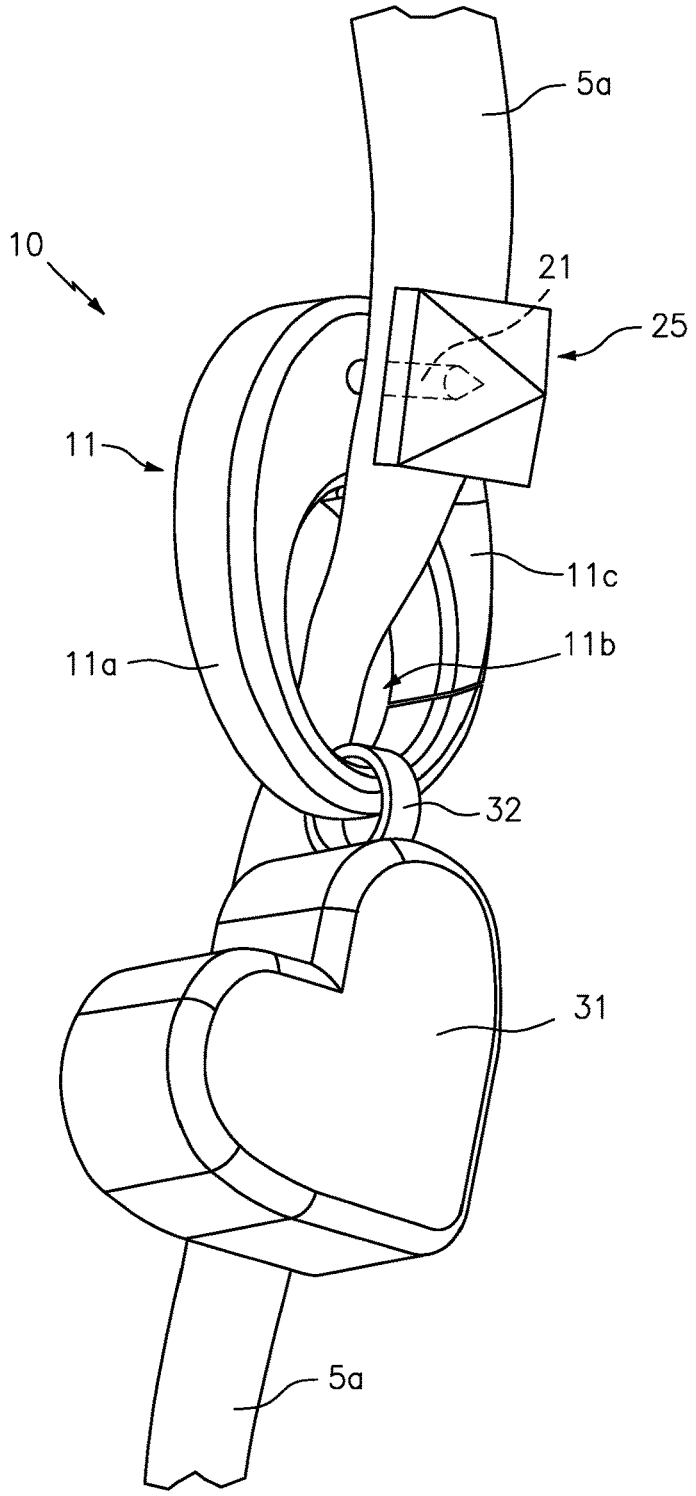
FIG. 5A is a perspective view of the charm and clothing attachment device in operation, in accordance with the one embodiment of the invention.
Figure 5B:
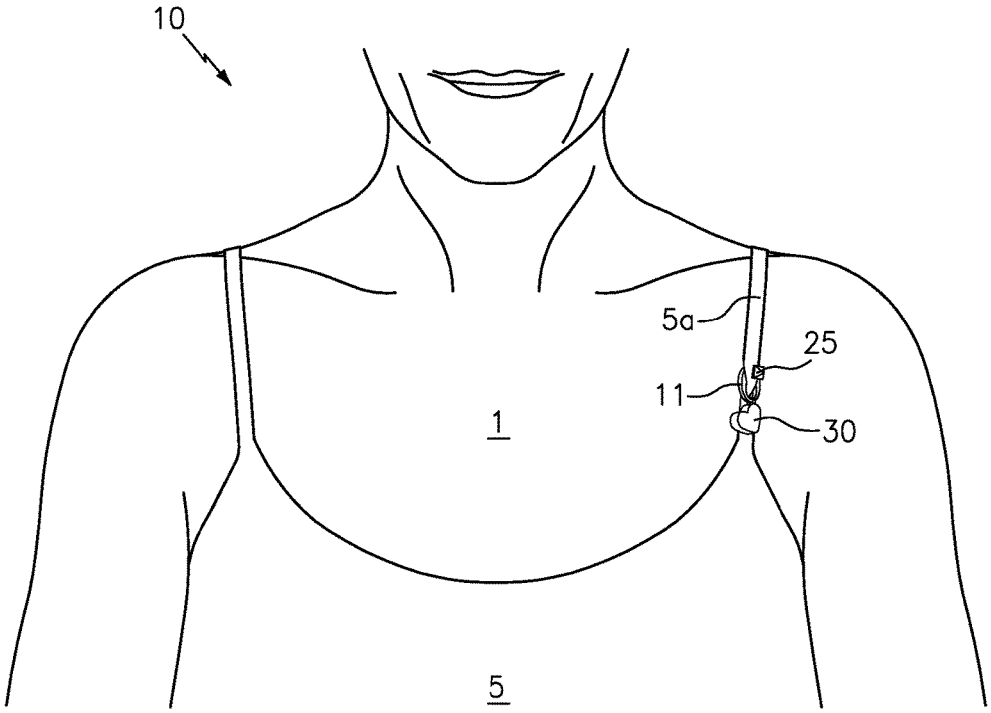
FIG. 5B is another perspective view of the charm and clothing attachment device in operation, in accordance with the one embodiment of the invention.

FIGS. 5A and 5B illustrate one embodiment of the device 10 in operation with a user 1. As shown, the device 10 can be secured onto an article of clothing 5, in this instance a bikini top having a strap 5*a*. As shown, the shaft 21 can pierce the strap material from behind, and can be locked in place via the receiver 25. At this time, the portion of the strap 5*a* located directly beneath the pierced section can be secured within the central aperture 11*b* of the main body 11 via the moveable arm 11*c*. When so located, the device 10 prominently displays the charm 5 on the front side of the article of clothing 1.

Moreover, by ensuring the central aperture 11*b* includes a suitable size for receiving the standard sized swimsuit strap 5*a*, the device provides two distinct advantages. First, such a feature provides two separate points of contact with the clothing, thereby preventing the charm from twisting or otherwise rotating, so as to not face the forward direction. Second, by also securing the strap within the aperture, the device 10 provides a redundant connection mechanism that ensures the user will not lose either the device 10 or the charm 30, even if the attachment unit 20 fails.

As described herein, one or more elements of the charm and clothing attachment device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the main body 11, the elongated shaft 21 and/or the charm 30, for example, may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A charm and clothing attachment device, said device comprising:

a main body having a hook portion, a central aperture and a selectively displaceable arm that is in communication with the hook portion;

an elongated shaft having that extends outward from a front facing surface of the main body, said shaft having a first end that is permanently secured to the main body and a second end that comprises a sharp pointed tip;

a receiver that includes a front facing surface, a rear facing surface and a cavity, said cavity functioning to receive the second end of the elongated shaft; and a connector that interposed between the receiver and the main body, said connector functioning to removably secure the second end of the elongated shaft within the receiver.

2. The device of claim 1, wherein the connector comprises:

a plurality of threaded elements that are disposed along a length of the elongated shaft; and a plurality of complementary threaded elements that are disposed along an inside portion of the cavity of the receiver, said threaded elements and complementary threaded elements being configured to secure the receiver to the shaft via a twisting motion.

3. The device of claim 1, wherein the connector comprises:

a first magnet that is disposed along the front facing surface of the main body; and a second magnet that is disposed along the rear facing surface of the receiver, wherein said first and second magnets include an opposite charge.

4. The device of claim 1, wherein the central aperture includes a diameter of between approximately 0.125 inches and 0.5 inches, and is configured to receive a strap from an article of clothing.

5. The device of claim 1, wherein the main body is constructed from at least one of a precious metal and a semi-precious metal.

6. The device of claim 1, wherein the receiver includes a decorative shape, and is constructed from at least one of a precious metal and a semi-precious metal.

7. The device of claim 1, further comprising:

at least one charm having a body portion and a loop portion, said loop portion including a shape and size that is suitable for receiving the hook portion of the main body.

8. The device of claim 7, wherein the at least one charm is permanently secured to the main body.

* * * * *